US012409969B2

(12) United States Patent
Ohno et al.

(10) Patent No.: US 12,409,969 B2
(45) Date of Patent: Sep. 9, 2025

(54) MANUFACTURING METHOD OF BOTTLE-SHAPED CAN FORMED OF METAL SHEET COATED WITH COLORED RESIN

(71) Applicant: DAIWA CAN COMPANY, Chiyoda-ku (JP)

(72) Inventors: Hiroyuki Ohno, Sagamihara (JP); Yukikazu Hiraide, Sagamihara (JP)

(73) Assignee: DAIWA CAN COMPANY, Chiyoda-ku (JP)

( * ) Notice: Subject to any disclaimer, the term of this patent is extended or adjusted under 35 U.S.C. 154(b) by 187 days.

(21) Appl. No.: 18/549,664

(22) PCT Filed: Feb. 9, 2022

(86) PCT No.: PCT/JP2022/005013

§ 371 (c)(1),
(2) Date: Sep. 8, 2023

(87) PCT Pub. No.: WO2022/190747

PCT Pub. Date: Sep. 15, 2022

(65) Prior Publication Data

US 2024/0150062 A1 May 9, 2024

(30) Foreign Application Priority Data

Mar. 8, 2021 (JP) ..... 2021-036099

(51) Int. Cl.
*B65D 1/02* (2006.01)
*B65D 1/40* (2006.01)
*B65D 65/42* (2006.01)

(52) U.S. Cl.
CPC ..... *B65D 1/0215* (2013.01); *B65D 1/40* (2013.01); *B65D 65/42* (2013.01)

(58) Field of Classification Search
CPC ..... B65D 1/0215; B65D 1/40; B65D 65/42
See application file for complete search history.

(56) References Cited

U.S. PATENT DOCUMENTS 7,031,022 B1 * 4/2006 Komori ..... B41F 33/0036 358/1.9
2017/0101227 A1 4/2017 Aagaard et al.
2021/0252847 A1 8/2021 Kagawa et al.

FOREIGN PATENT DOCUMENTS

EP 3660654 A1 * 6/2020 ..... B41J 3/40733
JP 64-64825 A 3/1989
(Continued)

OTHER PUBLICATIONS

International Search Report issued Apr. 26, 2022 in PCT/JP2022/005013, filed on Feb. 9, 2022, citing documents 1 & 16-18 therein, 2 pages.

*Primary Examiner* — Nathan H Empie
(74) *Attorney, Agent, or Firm* — Oblon, McClelland, Maier & Neustadt, L.L.P.

(57) ABSTRACT

A manufacturing method of a bottle-shaped can includes forming a cylindrical can trunk by drawing or ironing a metal sheet coated with a colored resin and printing a design on the outer surface of the can trunk. The manufacturing method further includes painting a predetermined section of the outer surface of the can trunk multiple times while changing colors of inks thereby collecting samples of colors resulting from mixing the colors of the inks with a ground color of the predetermined section, preparing a tone chart by groups of hues of the colors having the same brightness and colorfulness, determining a color scheme of the design with reference to the tone chart, and printing the design on the predetermined section in the determined color scheme.

12 Claims, 5 Drawing Sheets

(56) References Cited

FOREIGN PATENT DOCUMENTS

| | | | | |
|---|---|---|---|---|
| JP | 2-233344 | A | | 9/1990 |
| JP | 8-24958 | A | | 1/1996 |
| JP | 8-25550 | A | | 1/1996 |
| JP | 11-91773 | A | | 4/1999 |
| JP | 2003104349 | A | * | 4/2003 |
| JP | 2003-191374 | A | | 7/2003 |
| JP | 2003-246966 | A | | 9/2003 |
| JP | 2004-98552 | A | | 4/2004 |
| JP | 2004-314152 | A | | 11/2004 |
| JP | 3957049 | B2 | | 8/2007 |
| JP | 2008-18713 | A | | 1/2008 |
| JP | 2013-86413 | A | | 5/2013 |
| JP | 2014-240774 | A | | 12/2014 |
| JP | 2015-157482 | A | | 9/2015 |
| JP | 2018-161831 | A | | 10/2018 |
| JP | 2019155771 | A | * | 9/2019 |
| JP | 2020-124833 | A | | 8/2020 |

* cited by examiner

MANUFACTURING METHOD OF BOTTLE-SHAPED CAN FORMED OF METAL SHEET COATED WITH COLORED RESIN

TECHNICAL FIELD

This invention relates to a manufacturing method of a bottle-shaped can by drawing and ironing a metal sheet (blank) coated with a synthetic resin film or a paint, and printing a predetermined design on a surface.

BACKGROUND ART

A bottle-shaped can is manufactured by forming a metal sheet such as an aluminum alloy sheet or a steel sheet into a shape similar to a glass bottle in which a neck portion and a container mouth are drawn thinner than a trunk portion. Glass material of the glass bottles may be colored to decorate the glass bottles in the desired color. Therefore, it is desirable to decorate the bottle-shaped can in the desired color as the glass bottles. However, the bottle-shaped can is formed by drawing a shoulder portion and a neck portion formed between a can trunk and a container mouth on which a cap is mounted into a cylindrical portion whose diameter is smaller than that of the can trunk. That is, the metal sheet as the material of the bottle-shaped can is subjected to severe processing steps to be deformed significantly. To this end, for example, the metal sheet (blank) is coated with a colored layer in advance, and the metal sheet is drawn and ironed to be shaped into the bottle-shaped can. In this case, the metal sheet is subjected to severe processing steps to form the neck portion, the container mouth, and to form a thread on an outer surface of the neck portion. As a result, cracks and ruptures would develop on the coating. In addition, colorful patterns and letters (hereinafter referred to as design) are printed on the outer surface of the bottle-shaped can to advertise the commodity to consumers. To this end, many kinds of inks may be used to print the designs, and a base layer may be seen through the design depending on the kind on the used ink. In this case, the color of the base layer would be mixed with the color of the design. Consequently, a desired color intended by a designer may not be produced.

In order to solve the above-explained problems, in the conventional art, compositions and constituents of resin coatings have been changed in different manners. For example, according to the invention disclosed in the publication of Japanese Patent No. 3957049, chromatic pigment is mixed into an adhesion layer interposed between a transparent thermoplastic resin layer and an aluminum alloy sheet. Therefore, in the thinned trunk portion, the adhesion layer is thinned to serves as a glossy metal base layer of the printed pattern so that the color of the alloy sheet can be seen through the adhesion layer.

SUMMARY OF INVENTION

Technical Problem to be Solved by the Invention

Given that the blank is coated with a dark colored coating layer to decorate the bottle-shaped can entirely in the desired color as glass bottles, the color of the coating serves as a ground color in the thinned trunk portion which affects the color of the design. The effect of the base color seems likely to be changed depending on the color of the coating layer and a kind of the ink, but the color of the design would be changed in any case by the base color from the color intended by the designer. In addition, the blank is drawn to be thinned differently in each section of the bottle-shaped can, and the color of the coating layer is lightened (or faded) with the progress of drawing of the blank. That is, even if the pattern is designed based on the color (intensity, hue, brightness) of the coating layer applied to the blank, the base color would be changed with the progress of the processing. Therefore, it is difficult to print the design in the desired color. Nonetheless, it is possible to print a redesigned pattern again on the trunk portion of the bottle-shaped can so as to evaluate the finished printed design. However, such designs are not one colored. Therefore, even if the portion printed unsatisfactory by the previous printing process is printed in the desired color, other portions are not always printed in desired color and brightness. Consequently, the pattern would have to be redesigned over again, and the color of the coating would have to be changed over again.

According to the teachings of Japanese Patent No. 3957049, the glossy metal base layer is formed on the alloy sheet so that the color of the alloy sheet can be seen through the base layer thinned as a result of the forming process. However, the color of the resin coating has to be limited to the color similar to the color of the alloy sheet. Therefore, the bottle-shaped can may not be decorated in a colorful manner.

The present invention has been conceived noting the above-explained technical problems, and it is therefore an object of the present invention to provide a method of manufacturing a bottle-shaped can possible to decorate the bottle-shaped can including a can trunk and a neck portion entirely in a colorful manner, and to print the desired pattern easily or to determine the design of a pattern easily.

Means for Solving the Problem

According to the present invention, there is provided a manufacturing method of a bottle-shaped can formed of a metal sheet coated with a colored resin coating having a forming process including steps of forming a cylindrical can trunk by drawing or ironing the metal sheet coated with the colored resin coating, and thereafter printing a design on an outer surface of the can trunk. In order to achieve the above-explained objective, the manufacturing method comprises: painting a predetermined section of the outer surface of the can trunk multiple times while changing color of ink thereby collecting samples of colors resulting from mixing the colors of the inks with a ground color of the predetermined section; preparing a tone chart by groups of hues of colors having the same brightness and colorfulness; determining a color scheme of the design with reference to the tone chart; and printing the design on the predetermined section in the determined color scheme.

According to the present invention, the remaining area of the outer surface of the can trunk in which the design is not printed may be painted with the ink of the same or similar color as the color of the resin coating.

The bottle-shaped can manufactured by the method according to the present invention may be a bottle-shaped can comprising a bottom lid on which the design is not printed and which is seamed to an opening end of the can trunk. In addition, a color difference $\Delta E^*ab$ between: the color of the remaining area after painting the remaining area with the ink of the same or similar color as the color of the resin coating, and the color of the resin coating applied to the metal sheet; may be reduced to "10" or smaller.

According to the present invention, the brightness of the color of the resin coating may be lower than that of the ground color of the metal sheet, or colorfulness of the color of the resin coating may be higher than that of the ground color of the metal sheet.

Advantageous Effects of Invention

According to the present invention, the tone chart of the colors of the outer surface of the can trunk are prepared after applying the forming process to the metal sheet, and the color scheme of the design is determined with reference to the tone chart. That is, the design is determined based on the ground color deteriorated after execution of the forming process, different from the case of determining a color scheme of the design to be printed e.g., on a plain white paper. Therefore, the design may be printed on the can trunk in the intended color scheme by a single printing process. In a case of printing the design on the can trunk by a trial-and-error approach, the design whose color scheme has been temporarily determined is printed on the can trunk, and the quality of the printed design is evaluated. Then, the color scheme of the design is adjusted and the design is printed on the can trunk again. Thus, in this case, it is necessary to consider the color scheme multiple times and to print the design multiple times. Unlike the trial-and-error approach, according to the present invention, the color scheme of the design is determined taking account of the ground color. Therefore, the design may be printed in the determined color scheme almost without fail. For this reason, the design may be determined easily to be printed on the bottle-shaped can. Specifically, according to the present invention, the design is determined taking account of the deteriorated color of the can trunk. Therefore, a possibility of failure of a determination in color scheme may be reduced significantly.

In addition, according to the present invention, the area of the outer surface of the can trunk in which the design is not printed is painted with the ink of the same or similar color as the color of the resin coating. Therefore, even if the color of the can trunk is deteriorated by the forming process, the design may be printed on the can trunk as intended by restoring the color of the can trunk.

Specifically, the color difference $\Delta E^*ab$ between: the color of the remaining area after painting the remaining area with the ink of the same or similar color as the color of the resin coating, and the color of the resin coating applied to the metal sheet; is reduced to "10" or smaller. Therefore, color unevenness of the bottle-shaped can may remain inconspicuous, and hence the design may be printed as intended.

DESCRIPTION OF EMBODIMENT(S)

Figure 1:
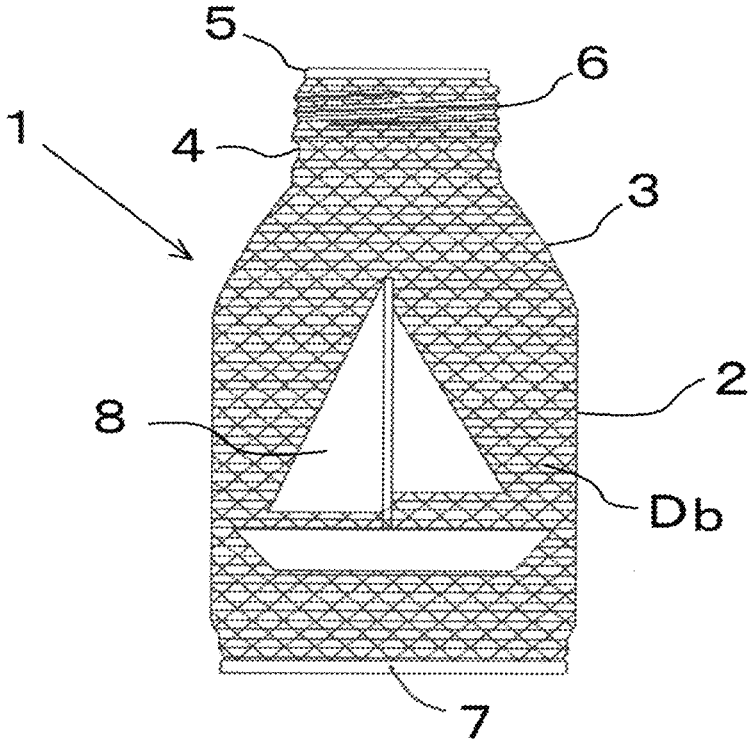
FIG. 1 is a front view showing one example of the bottle-shaped can manufactured by the manufacturing method according to the present invention.

The present invention relates to a manufacturing method of a bottle-shaped can in which a can trunk and a neck portion are formed integrally from a metal sheet material. The bottle-shaped can includes a two-piece type bottle-shaped can in which a bottom and the trunk section are formed integrally, and a three-piece type bottle-shaped can in which a bottom lid is seamed to the trunk section. One example of the three-piece type bottle-shaped can 1 is schematically shown in FIG. 1. In the bottle-shaped can 1, a shoulder section 3 is formed from a cylindrical trunk section 2 such that a diameter of the bottle-shaped can 1 is reduced gradually toward an upper side. A cylindrical neck section 4 extends upwardly from the shoulder section 3, and an upper end of the neck section 4 is opened to serve as a container mouth 5. A male thread 6 is formed around the neck section 4, and a not shown cap is mounted on the neck section 4 to close the bottle-shaped can 1 in a detachable manner. That is, the bottle-shaped can 1 is a resealable can. In addition, a bottom lid 7 is seamed to a bottom of the trunk section 2, and an opening end of the container mouth 5 is curled outwardly.

The neck section 4 and the container mouth 5 serve as a container neck, and the container neck and the trunk section 2 are colored entirely. The bottle-shaped can 1 is formed of a metal sheet (i.e., a blank) such as an aluminum sheet and a steel sheet, and as explained later, a colored resin coating is applied to the metal sheet for the purpose of coloring the bottle-shaped can 1. Accordingly, the blank serves as a "metal sheet coated with a colored resin coating" of the present invention. For example, brightness of the color of the colored resin coating is lower than that of a color of the blank, or colorfulness of the color of the colored resin coating is higher than that of the color of the blank. In FIG. 1, the colored resin coating is illustrated as a cross-hatching. In the trunk section 2, a design 8 such as a pattern and letters is printed on the colored resin-coated metal sheet.

Figure 2:
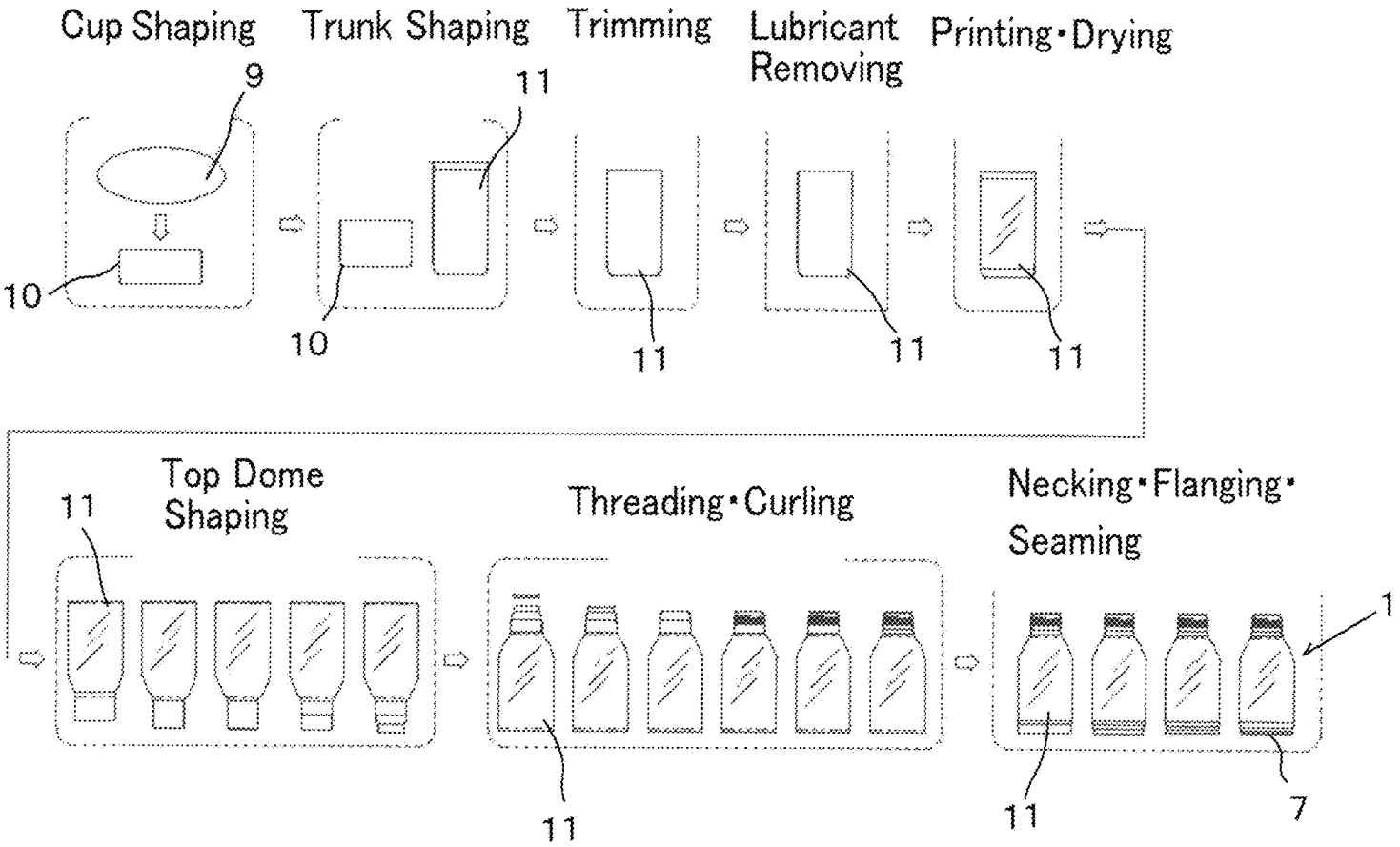
FIG. 2 is a block diagram showing steps of the manufacturing method according to the present invention.

Turning to FIG. 2, there is shown a manufacturing process of the above-explained bottle-shaped can 1. At a cup shaping step as a first step, a blank 9 is drawn into a cup 10. As described, the blank 9 is a thin metal material such as an aluminum sheet and a steel sheet, and the blank 9 is punched out of the metal material into a predetermined shape such as a circular shape. In addition, the colored resin coating is painted on or affixed to a surface of the blank 9 to be an outer surface of the bottle-shaped can 1.

Then, at a can trunk shaping step, a drawing treatment or an ironing treatment and a drawing/ironing treatment are applied to stretch the cup 10 in an axial direction. Consequently, the cup 10 is shaped into a bottomed cylinder 11 whose thickness is reduced. After that, at a trimming step, an opening end of the bottomed cylinder 11 is trimmed to align the height of the opening end. During the drawing and the ironing, lubricant is applied to the cup 10, therefore, the lubricant is subsequently removed at a lubricant removal step. Details of such application and removal of the lubricant is described in the above-mentioned Japanese Patent No. 3957049. As explained later in detail, a design is printed on the bottomed cylinder 11, and the bottomed cylinder 11 is then cured.

The method explained herein is a manufacturing method of the three-piece type bottle-shaped can. Accordingly, at a subsequent top dome shaping step, a bottom section of the bottomed cylinder 11 is drawn into a diametrically smaller cylindrical section having a domed circumferential wall. An outer diameter of the diametrically smaller cylindrical section is further reduced gradually to form the container neck while shaping the domed wall into the smooth shoulder section. After thus forming the shoulder section 3 and the neck section 4 continued from the trunk section 2, the leading end of the neck section 4 is cut out (i.e., trimmed) thereby forming the container mouth 5. Then, the male thread 6 is formed on the neck section 4 at a threading step, and an opening edge of the container mouth 5 is curled outwardly at a curling step. Thereafter, a flange is formed on the lower end of the trunk section 2 at a necking/flanging step, and the bottom lid 7 is seamed by the flange at a seaming step. The above-explained top doming, threading, and curling steps, as well as the necking/flanging and seaming steps of the bottom side may be executed by the conventionally known methods.

Figure 3:
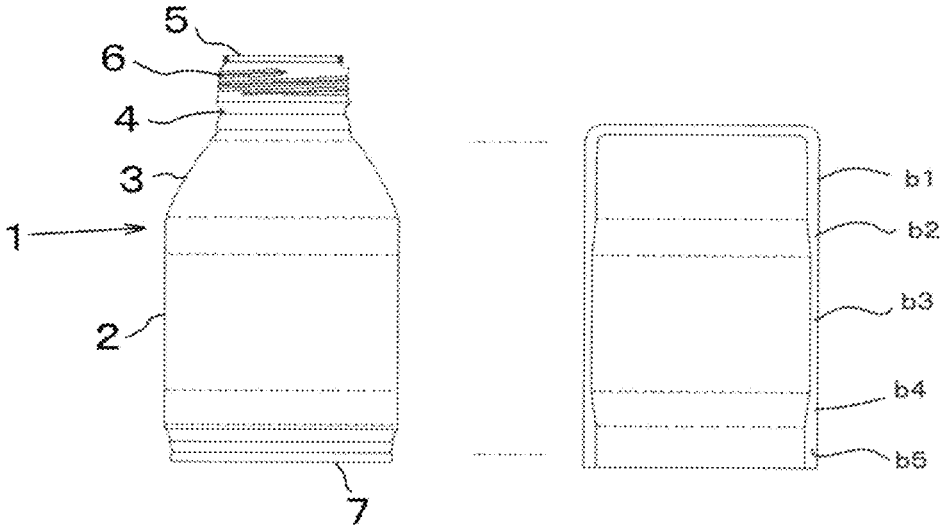
FIG. 3 is a schematic illustration showing a wall thickness of each portion of a bottomed cylinder to be shaped into the bottle-shaped can.

It is required not only to ensure rigidity and strength of the bottle-shaped can 1 manufactured by the foregoing steps, but also to ensure rigidity and strength of the bottle-shaped can 1 to bear loads applied thereto during execution of the foregoing steps. Therefore, thickness of each section is set to satisfy the above-mentioned requirements and to reduce an amount of the material as much as possible. Turning to FIG. 3, there is shown a wall thickness of each section of the bottomed cylinder 11 after being thinned at the ironing step corresponding to each section of the bottle-shaped can 1.

In the bottomed cylinder 11, an interim trunk section b3 corresponding to the trunk section 2 of the bottle-shaped can 1 is a cylindrical section and hence a buckling strength of the interim trunk section b3 is high. Accordingly, a wall thickness of the interim trunk section b3 is reduced thinner than those of the other sections. Whereas, an interim shoulder section b1 of the bottomed cylinder 11 corresponding to the shoulder section 3 and the neck section 4 of the bottle-shaped can 1 inclines with respect to a load (i.e., an axial load) applied to the bottle-shaped can 1 from above. Therefore, a wall thickness of the interim shoulder section b1 is maintained thicker than the wall thickness of the interim trunk section b3. An interim bottom section b5 having an opening is to be drawn to reduce a diameter thereof at the necking step, and the bottom lid 7 is seamed to the interim bottom section b5 by the flange at the seaming step. That is, a portion drawn to reduce the diameter thereof is subjected to the axial load. Therefore, in order to ensure strength to bear the axial load, a wall thickness of the interim bottom section b5 is maintained thicker than the wall thickness of the interim trunk section b3. Thus, in the bottomed cylinder 11, the wall thicknesses of the interim shoulder section b1 formed above the interim trunk section b3 and the interim bottom section b5 formed below the interim trunk section b3 are thicker, and the wall thickness of the bottomed cylinder 11 changes gradually in an upper intermediate section b2 and a lower intermediate section b4.

Figure 4:
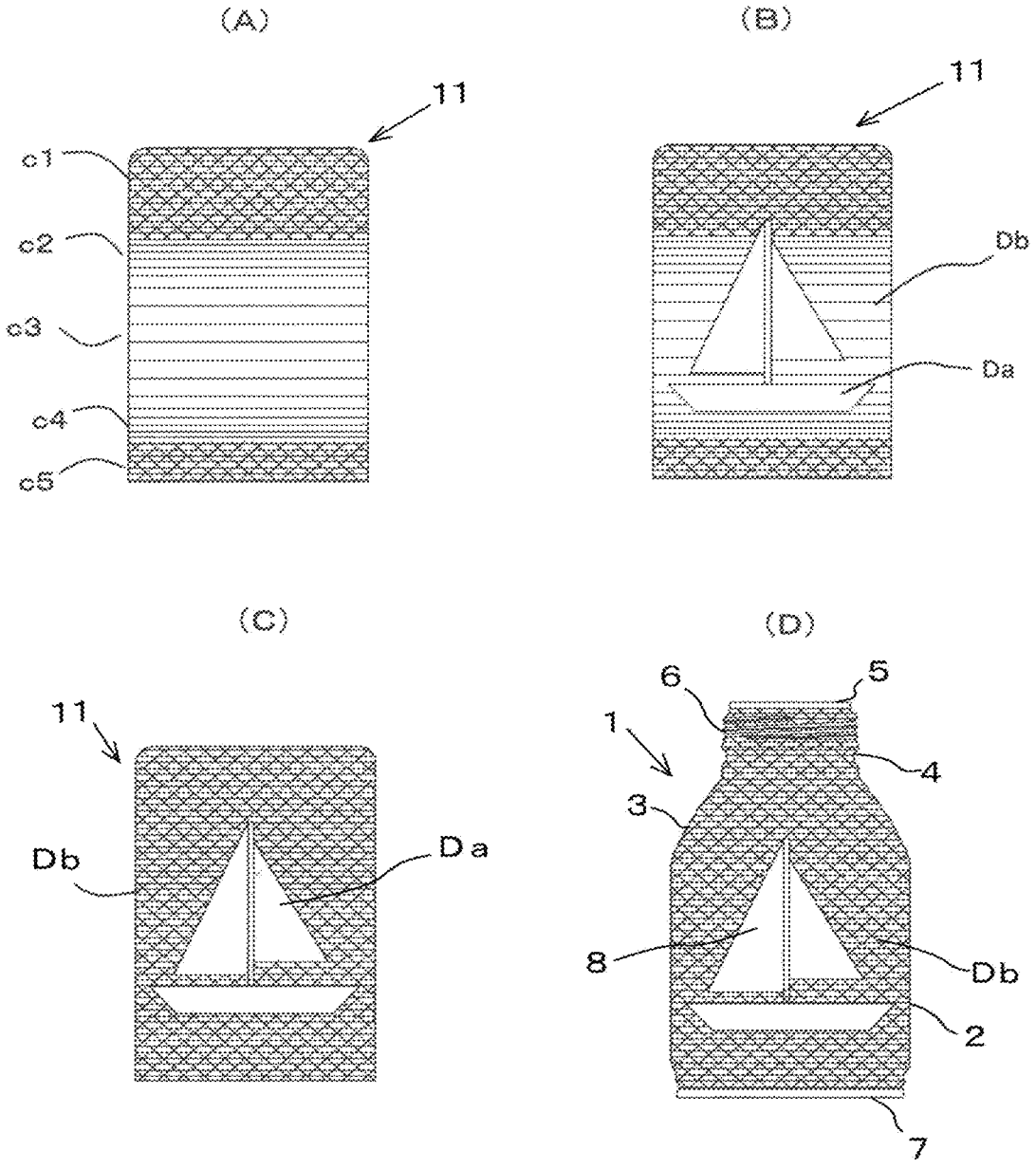
FIGS. 4 (A) to (D) are schematic illustrations in which deterioration of color, the design printed on the can trunk, the deteriorated color after restoration, and the bottle-shaped can formed after restoring the color, are shown in order.

As explained above, the wall thickness is changed as a result of a flow of the material caused by the above-explained drawing and ironing. That is, the colored resin coating formed on the blank 9 is expanded by the flow of the material during the process of shaping the blank 9 into the cup 10, and consequently the color of the resin coating is changed. As a result of such change in the color of the resin coating, colorfulness and brightness of the color of the resin coating will be increased. That is, the color is deteriorated. Such deterioration of color is schematically shown in FIG. 4 (A). In FIG. 4 (A), cross-hatched sections c1 and c5 where clearances between lateral lines are narrow correspond to the aforementioned interim shoulder section b1 and the interim bottom section b5, respectively, and the color deterioration is less in each of the cross-hatched sections c1 and c5. An unhatched section c3 in which clearances between the lateral lines are widest corresponds to the aforementioned interim trunk section b3, and the color deterioration is most serious in the unhatched section c3. Unhatched sections c2 and c4 in which clearances between the lateral lines change gradually correspond to the aforementioned intermediate sections b2 and b4, respectively, and a degree of the color deterioration changes gradually in the unhatched sections c2 and c4. In the sections c1 to c5, the wall thickness changes as explained with reference to FIG. 3. That is, the deterioration of color is most serious in the interim trunk section b3, and the degree of color deterioration changes gradually therefrom toward the interim shoulder section b1 through the upper intermediate section b2 and toward the interim bottom section b5 through the lower intermediate section b4.

As illustrated in FIG. 4 (B), a design Da is printed on a section between the upper intermediate section b2 and the lower intermediate section b4 across the interim trunk section b3. In this situation, if the design is printed on e.g., a white base layer in a region where the color of the base layer is deteriorated, the color(s) of an ink or a paint of the design is/are undesirably mixed with the deteriorated color of the base layer. In this case, therefore, an intended design may not be printed. Whereas, if the color of the base layer is pale gloss color so that a silver ground color of the metal sheet can be seen through the base layer as described in the publication of Japanese Patent No. 3957049, a pattern to be printed may be designed based on the ground color in most cases. In this case, therefore, the design is rarely affected by the ground color. However, if the color of the colored resin coating is black or brown, colorfulness of the colored resin coating is high and the brightness of the colored resin coating is low. In this case, the color of the design would be affected significantly by the color of the colored resin coating. That is, a difference in deterioration (i.e., tint) of the color of the colored resin coating would directly affect the color of the design.

Figure 5:
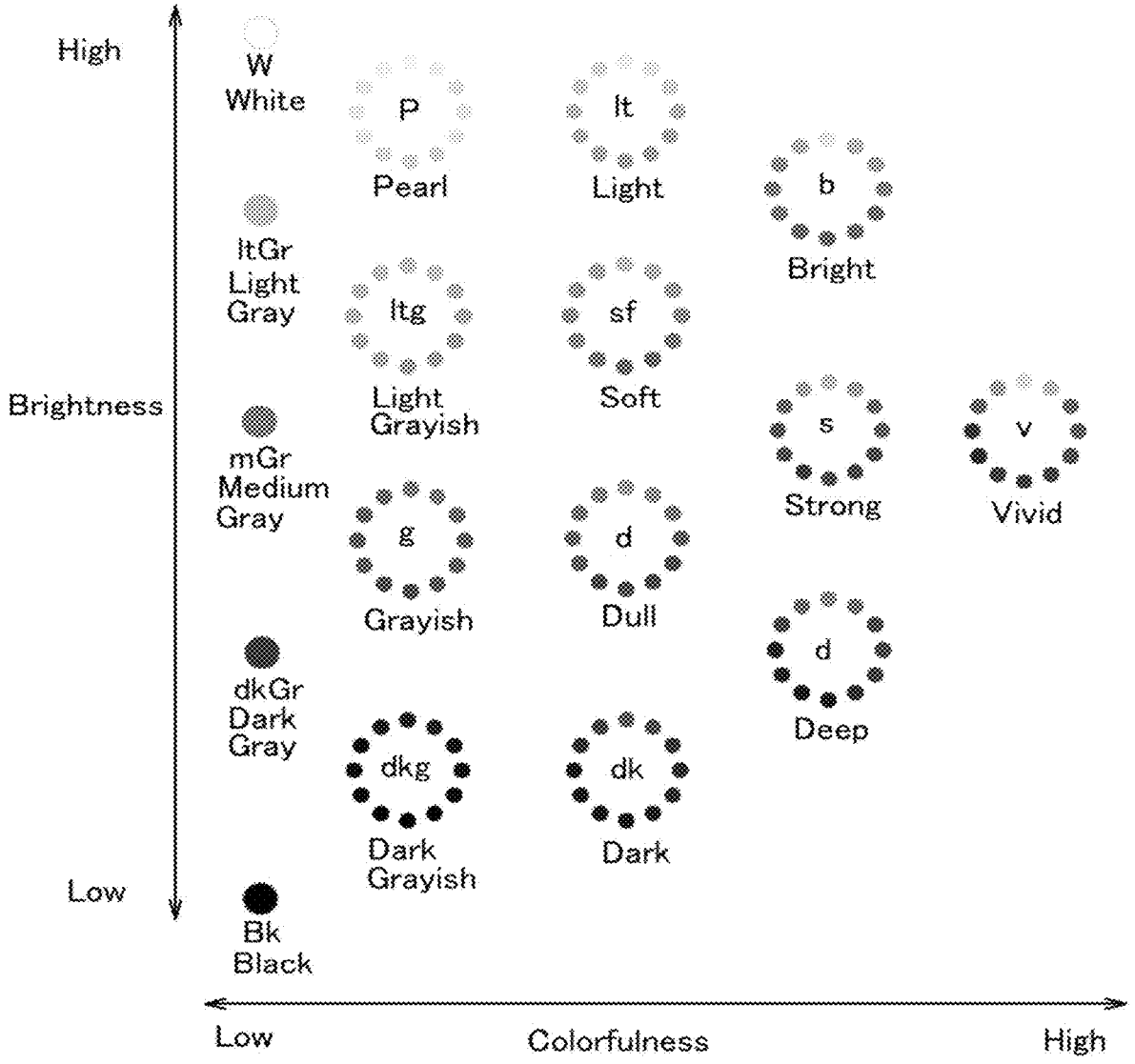
FIG. 5 is one example of a tone chart illustrated in an achromatic color.

Therefore, according to the method of the present invention, the bottomed cylinder 11 in which the color of the resin coating has been deteriorated by the forming process is painted experimentally with a plurality of inks of different colors to be used to draw the design Da. Then, a tone chart of samples of colors resulting from mixing the colors of the inks with the deteriorated colors of the resin coating and the initial color of the resin coating is prepared based on the result of experimentation. As known in the conventional art, a tone is a group of hues of colors having the same brightness and colorfulness. As schematically shown in FIG. 5, the tone chart categorizes the hues of the colors of the inks to be used to draw the design Da by tone. Here, although FIG. 5 is printed in black and white, the tone chart is actually prepared in full color.

A color scheme of each part of the design Da and the inks to be used to draw the design Da are determined with reference to the tone chart, and the design Da is printed on a desired site of the bottomed cylinder 11. The remaining area Db in which the design Da is not printed but the color of the resin coating is deteriorated is painted with the ink of the same or similar color as the color of the ink used to paint the interim shoulder section b1 and the interim bottom section b5. In other words, the remaining area Db is painted with the ink of the same or similar color as the color of the resin coating applied to the blank 9. The bottomed cylinder 11 on which the design Da has been printed and in which the deteriorated color of the resin coating has been restored is schematically shown in FIG. 4(C). FIG. 4(C) is also printed in black and white, therefore, the ground color of the bottomed cylinder 11 and the density of the ground color are indicated by the cross-hatching. Then, the above-mentioned top doming, threading, curling, necking/flanging, and seaming are applied to the bottomed cylinder 11 shown in FIG.

4(C) on which the design Da has been printed. Consequently, as shown in FIG. 4(D), the bottomed cylinder 11 shown in FIG. 4(C) is shaped into the bottle-shaped can 1.

Thus, according to the method of the present invention, the color(s) of the ink(s) used to paint the design Da on the bottle-shaped can 1 is/are selected taking account of the ground color of the outer surface of the bottle-shaped can 1 which has been subjected to the forming process. Therefore, the design 8 may be printed on the bottle-shaped can 1 in the intended color(s) and tone(s) as designed by the existing manufacturing process. For this reason, frequencies of redesigning and printing can be reduced significantly compared to a case of printing a design stepwise by a trial-and-error approach such as printing the design tentatively on the bottomed cylinder 11 and thereafter adjusting the color(s) of the design by printing the design again. In other words, the printing process and the manufacturing process of the bottle-shaped can 1 may be simplified, and the design may be printed easily on the bottle-shaped can 1 as designed.

According to the present invention, it is preferable to restore the color deteriorated by the forming process especially in the remaining area Db in which the design Da is not printed. For this purpose, in order to unify the color of the bottle-shaped can 1, it is preferable to paint an area of the remaining area Db where the color of the resin coating is deteriorated indistinguishably from an area of the remaining area Db where the color of the resin coating is not restored. To this end, inventors of the present invention prepared a three-piece type bottle-shaped can 1 from a blank 9 to which a resin coating colored with gold pigment as a medium color is applied, and a three-piece type bottle-shaped can 1 from a blank 9 to which a resin coating colored with black pigment as a deep color is applied. Here, those bottle-shaped cans 1 were manufactured by the above-explained forming process. As described, in the three-piece type bottle-shaped can, a design is not printed on the can bottom (that is, the can bottom cannot be painted or colored). Then, a color difference ΔE*ab (on the basis of the can bottom which cannot be painted) in each of the above-mentioned sections c1 to c5 shown in FIG. 4(A) was measured respectively using a chromometer KONICA MINOLTA CR-5. Specifically, the color difference ΔE*ab may be expressed as:

$$\Delta E^*ab=[(\Delta L^*)^2+(\Delta a^*)^2+(\Delta b^*)^2]^{1/2};$$

where ΔL* is a difference in brightness, Δa* is a difference in brightness, and Δb* is a difference in colorfulness, between two colors compared in a color space Lab.

The measurement results are shown in Table 1.

TABLE 1

(ΔE*ab measured in each section on the basis of the initial color of the resin coating)

| | Medium Color (Gold) | | Deep Color (Black) | |
|---|---|---|---|---|
| Measurement Section | Before Restoration | After Restoration | Before Restoration | After Restoration |
| C1 | 5.57 | 6.13 | 3.39 | 2.94 |
| C2 | 11.81 | 6.58 | 16.38 | 8.78 |
| C3 | 15.94 | 7.83 | 23.84 | 10.15 |
| C4 | 13.28 | 7.39 | 20.73 | 10.32 |
| C5 | 12.11 | 6.62 | 14.77 | 9.93 |

In Table 1, the definition of "Before Restoration" is the trunk of the can in which the color thereof is deteriorated as a result of the ironing process, and the definition of "After Restoration" is the trunk of the can in which the color thereof has been restored by painting a site where the color thereof deteriorated as a result of the ironing process with the same or similar color as the color of the resin coating. As can be seen from Table 1, the color difference ΔE*ab is largest at the section C3 corresponding to the interim trunk section b3 in both of the can trunk coated with the gold coating and the can trunk coated with the black coating. That is, the deterioration in color is most serious in this section. Especially, in the can trunk coated with the black coating, the color difference ΔE*ab in the section C3 is "23.84", and it is significantly greater than that in the same section of the can trunk coated with the gold coating. Therefore, it is assumed that the deeper color is deteriorated more significantly by the forming process, and it is necessary to be restored by painting.

The color of the bottomed cylinder 11 deteriorated by the forming process was painted to be restored, and then the color difference ΔE*ab in each of the sections c1 to c5 was individually measured. Specifically, the deteriorated color was restored by the conventional method such as a solid printing using the ink of the same or similar color as the color of the resin coating applied to the blank 9, or a gradation printing using a halftone. The color differences ΔE*ab after restoring the deteriorated color are as shown in Table 1, and degree of a color unevenness on the bottomed cylinder 11 or the bottle-shaped can 1 was monitored.

Specifically, 10 monitors were delegated, and a color unevenness of the bottomed cylinder 11 or the bottle-shaped can 1 after restoring the color was evaluated visually by each monitor. As a result, 2 monitors had an impression that there was a slight color unevenness, but other 8 monitors did not find any color unevenness. Based on the result of such monitoring, in the three-piece type bottle-shaped can according to the present invention in which a design is not printed on the bottom lid, the color difference ΔE*ab on the basis of the initial color of the resin coating (applied to the blank 9) in the area where the design is not printed is set to "10" or smaller. According to the present invention, therefore, color unevenness of the bottle-shaped can may not be sensed by the consumer not only in the case of coating the blank with the resin coating in the color of medium color, but also in the case of coating the blank with the resin coating in the color of dark color such as black. For this reason, an appearance of the bottle-shaped can may be improved.

The invention claimed is:

1. A manufacturing method of a bottle-shaped can formed of a metal sheet coated with a colored resin coating having a forming process including forming a cylindrical can trunk by drawing or ironing the metal sheet coated with the colored resin coating, and printing a design on an outer surface of the can trunk, comprising:

painting a predetermined section of the outer surface of the can trunk multiple times while changing colors of inks thereby collecting samples of colors resulting from mixing the colors of the inks with a ground color of the predetermined section;

preparing a tone chart by groups of hues of the colors having a same brightness and colorfulness;

determining a color scheme of the design with reference to the tone chart; and printing the design on the predetermined section in the determined color scheme.

2. The manufacturing method of the bottle-shaped can formed of the metal sheet coated with the colored resin coating as claimed in claim 1, further comprising:

painting a remaining area of the outer surface of the can trunk in which the design is not printed with the ink of same or similar color as the color of the resin coating.

3. The manufacturing method of the bottle-shaped can formed of the metal sheet coated with the colored resin coating as claimed in claim 2, wherein the bottle-shaped can comprises a bottom lid on which the design is not printed and which is seamed to an opening end of the can trunk, and each color difference ΔE*ab of color differences between the colors of the remaining area after painting the remaining area with the ink of the same or similar color as the color of the resin coating and the color of the resin coating applied to the metal sheet, is reduced to 10 or smaller.

4. The manufacturing method of the bottle-shaped can formed of the metal sheet coated with the colored resin coating as claimed in claim 1, wherein the colors of the outer surface of the can trunk are deteriorated as a result of thinning the metal sheet by the forming.

5. The manufacturing method of the bottle-shaped can formed of the metal sheet coated with the colored resin coating as claimed in claim 1, wherein the brightness of the color of the resin coating is lower than the brightness of the ground color of the metal sheet, or the colorfulness of the color of the resin coating is higher than the colorfulness of the ground color of the metal sheet.

6. The manufacturing method of the bottle-shaped can formed of the metal sheet coated with the colored resin coating as claimed in claim 2, wherein the colors of the outer surface of the can trunk are deteriorated as a result of thinning the metal sheet by the forming.

7. The manufacturing method of the bottle-shaped can formed of the metal sheet coated with the colored resin coating as claimed in claim 3, wherein the colors of the outer surface of the can trunk are deteriorated as a result of thinning the metal sheet by the forming.

8. The manufacturing method of the bottle-shaped can formed of the metal sheet coated with the colored resin coating as claimed in claim 2, wherein the brightness of the color of the resin coating is lower than the brightness of the ground color of the metal sheet, or the colorfulness of the color of the resin coating is higher than the colorfulness of the ground color of the metal sheet.

9. The manufacturing method of the bottle-shaped can formed of the metal sheet coated with the colored resin coating as claimed in claim 3, wherein the brightness of the color of the resin coating is lower than the brightness of the ground color of the metal sheet, or the colorfulness of the color of the resin coating is higher than the colorfulness of the ground color of the metal sheet.

10. The manufacturing method of the bottle-shaped can formed of the metal sheet coated with the colored resin coating as claimed in claim 4, wherein the brightness of the color of the resin coating is lower than the brightness of the ground color of the metal sheet, or the colorfulness of the color of the resin coating is higher than the colorfulness of the ground color of the metal sheet.

11. The manufacturing method of the bottle-shaped can formed of the metal sheet coated with the colored resin coating as claimed in claim 6, wherein the brightness of the color of the resin coating is lower than the brightness of the ground color of the metal sheet, or the colorfulness of the color of the resin coating is higher than the colorfulness of the ground color of the metal sheet.

12. The manufacturing method of the bottle-shaped can formed of the metal sheet coated with the colored resin coating as claimed in claim 7, wherein the brightness of the color of the resin coating is lower than the brightness of the ground color of the metal sheet, or the colorfulness of the color of the resin coating is higher than the colorfulness of the ground color of the metal sheet.

* * * * *